US007836636B2

(12) United States Patent
Luchsinger

(10) Patent No.: US 7,836,636 B2
(45) Date of Patent: Nov. 23, 2010

(54) PNEUMATIC STRUCTURAL ELEMENT

(75) Inventor: Rolf Luchsinger, Aathal-Seegräben (CH)

(73) Assignee: Prospective Concepts AG, Glattbrugg (CH)

( * ) Notice: Subject to any disclaimer, the term of this patent is extended or adjusted under 35 U.S.C. 154(b) by 0 days.

(21) Appl. No.: 12/086,907

(22) PCT Filed: Dec. 22, 2006

(86) PCT No.: PCT/CH2006/000732

§ 371 (c)(1),
(2), (4) Date: Aug. 20, 2008

(87) PCT Pub. No.: WO2007/071101

PCT Pub. Date: Jun. 28, 2007

(65) Prior Publication Data

US 2009/0282746 A1 Nov. 19, 2009

(30) Foreign Application Priority Data

Dec. 23, 2005 (CH) ..... 2074/05

(51) Int. Cl.
*E04B 1/34* (2006.01)

(52) U.S. Cl. ..... 52/2.11; 52/83; 52/88

(58) Field of Classification Search ..... 52/2, 52/18, 80.2, 81.3, 83, 86, 88; 248/560; 135/122, 135/123, 125, 127
See application file for complete search history.

(56) References Cited

U.S. PATENT DOCUMENTS 4,924,638 A * 5/1990 Peter ..... 52/86
4,976,074 A 12/1990 Delamare et al.
6,065,252 A 5/2000 Norsen et al.
6,332,290 B1 * 12/2001 Delamare ..... 52/2.22
6,860,220 B2 * 3/2005 Fleming ..... 114/345

FOREIGN PATENT DOCUMENTS

| | | |
|---|---|---|
| DE | 1557401 | 9/1969 |
| EP | 1903559 | 3/2008 |
| WO | WO-2005/007991 | 1/2005 |
| WO | WO-2005/021898 | 3/2005 |
| WO | WO-2005/042880 | 5/2005 |

OTHER PUBLICATIONS

Delzor, Francois, International Search Report for PCT/CH2006/000732 as mailed May 3, 2007 (6 pages).

* cited by examiner

*Primary Examiner*—Brian E Glessner
*Assistant Examiner*—Patrick Maestri
(74) *Attorney, Agent, or Firm*—Winstead PC

(57) ABSTRACT

The pneumatic structural element according to the invention comprises from one to a number of interconnected elements of the following construction: two hollow bodies (1) with casings (9) made of textile material preferably coated in a gas-tight manner and having end caps (5) are assembled such that they produce a common sectional area (2). The edging of this sectional area (2) is formed by two curved tension/compression elements (3) into which is clamped a web (4) made of a flexible material of high tensile strength. By filling the two hollow bodies (1) with compressed gas, a tensile stress σ is built up in their casings (9) and is transmitted directly or via the tension/compression elements (3) to the web (4) and pretensions said web. This pretensioning greatly increases the bending rigidity of the tension/compression elements (3). If a plurality of such elements is combined to form a roof, every two adjacent hollow bodies (1) thus form a sectional area (2) with a tension/compression element (3) and web (4).

16 Claims, 8 Drawing Sheets

PNEUMATIC STRUCTURAL ELEMENT

BACKGROUND OF THE INVENTION

1. Technical Field

The present invention relates to a pneumatic structural element.

2. History of the Related Art

Such, usually beam-like, pneumatic structural elements and also those having a surface formation have become increasingly known over the last few years. These are mostly attributed to EP 01 903 559 (D1). A further development of said invention is provided in WO 2005/007991 (D2). Here, the compression rod has been further developed into a pair of curved compression rods which can also absorb tensile forces and are therefore designated as tension/compression elements. These run along respectively one surface line of the cigar-shaped pneumatic hollow body. D2 is considered to be the nearest prior art.

The strong elevated bending rigidity of the tension/compression elements loaded with compressive forces is based on the fact that a compression rod used according to D2 can be considered as an elastically bedded rod over its entire length, wherein such a rod is bedded on virtual distributed elasticities each having the spring hardness k.

The spring hardness k is there defined by $$k=np$$

where k=virtual spring hardness [N/m$^2$]

p=pressure in hollow body [N/m$^2$]

with the result that the bending load $F_k$ is obtained as $$F_k=2\sqrt{k\cdot E\cdot I}[N]$$

where

E=modulus of elasticity [N/m$^2$]

I=areal moment of inertia [m$^4$]

SUMMARY OF THE INVENTION

The object of the present invention is to provide a pneumatic structural element having tension/compression elements and an elongated gas-tight hollow body which can be formed and expanded into both curved and/or surface structures, having a substantially increased bending load $F_k$ compared with the pneumatic supports and structural elements known from the prior art.

Beyond the formulated object, the intention is to provide a pneumatic structural element comprising a hollow body which can be formed independently of the form of the tension/compression elements determined by static conditions, in particular independently of the form of the tension element.

Likewise, beyond the formulated object, the intention is to provide a pneumatic structural element that exhibits less deformation under operating load than is the case with the pneumatic structural elements of the prior art.

BRIEF DESCRIPTION OF THE DRAWINGS

A more complete understanding of the device of the present invention may be obtained by reference to the following Detailed Description, when taken in conjunction with the accompanying Drawings, wherein.

DETAILED DESCRIPTION OF ILLUSTRATIVE EMBODIMENTS OF THE INVENTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1:
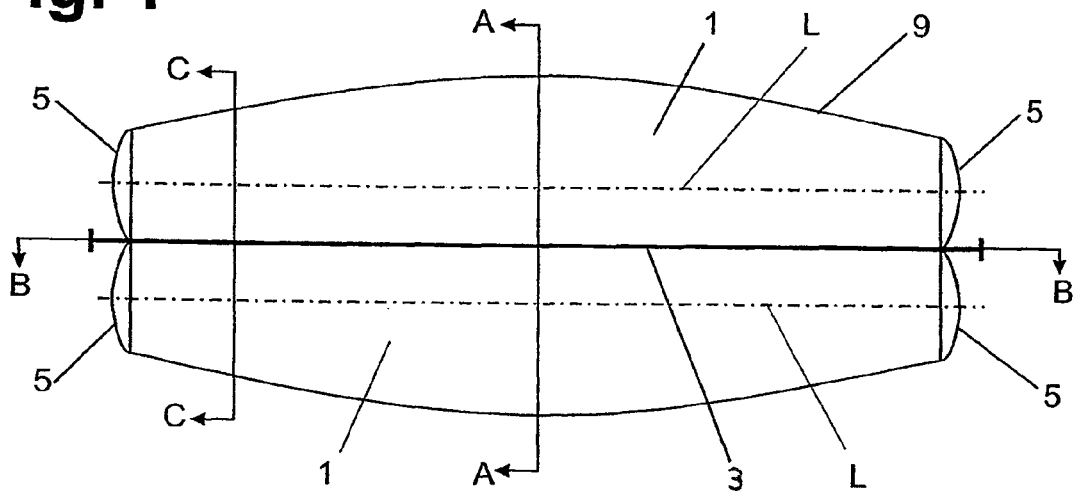
FIG. 1 is a plan view of a first exemplary embodiment of a pneumatic structural element.

FIG. 1 shows the pneumatic structural element according to the invention in a first exemplary embodiment in plan view. It is formed from two elongated, for example, cigar-shaped gas-tight hollow bodies 1 comprising a casing 9 and respectively two end caps 5, the hollow bodies 1 each having a straight center line L. Other forms of hollow bodies 1 are included in the description to FIG. 12.

Figure 2A:
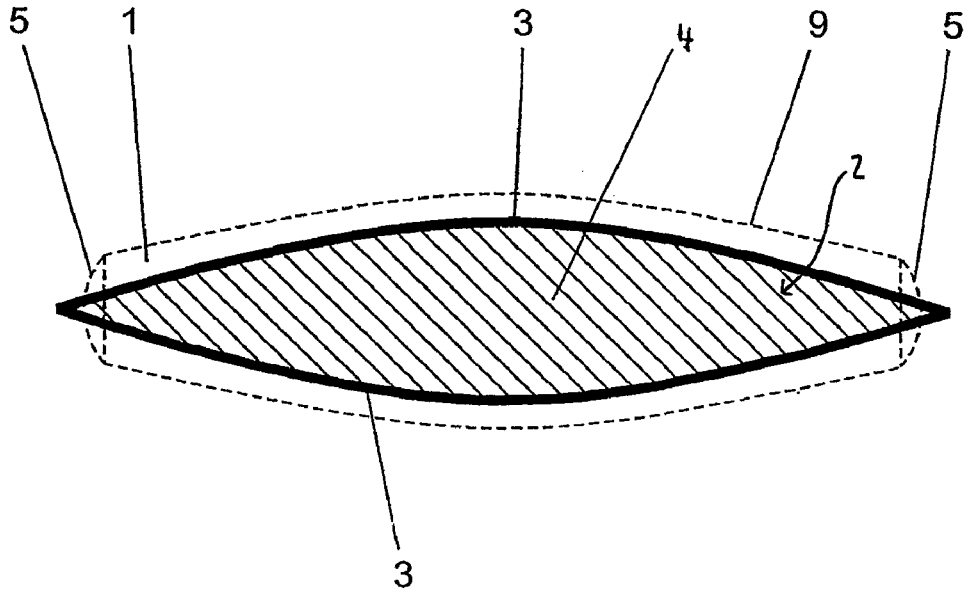
FIG. 2*a* is a cross-sectional view about line B-B of the exemplary embodiment of FIG. 1.

The casing 9 in each case consists, for example, of a textile-laminated plastic film or of flexible plastic-coated fabric. These hollow bodies 1 intersect one another, abstractly geometrically, in a sectional area 2 as can be seen from FIGS. 2*a* and 2*b*, which forms a section BB through FIG. 1.

When the two hollow bodies 1 are filled with compressed gas, they acquire the form shown in section AA of FIG. 4, under the conditions described hereinafter. As a result of the pressure p in the interior of the hollow body 1, a linear stress .σ. is built up in its casings 9, which is given by $$\sigma=pR$$

σ=linear stress [N/m]

p=pressure [N/m$^2$]

R=radius of the hollow body 1 [m]

Figure 3:
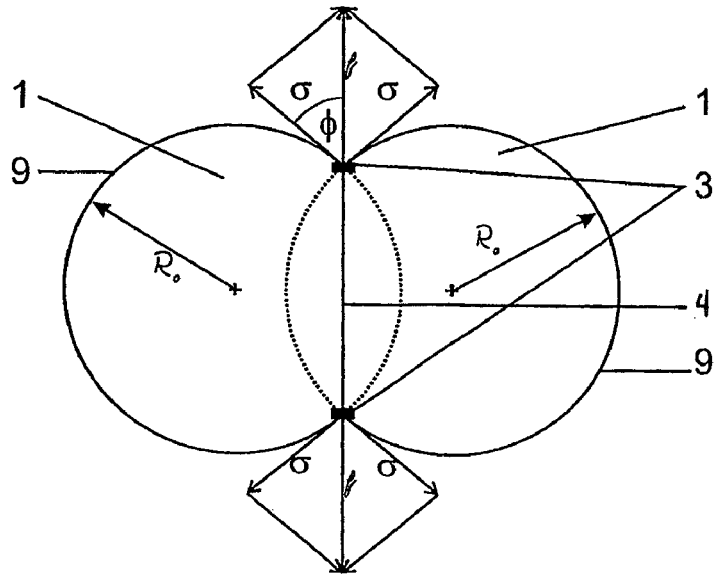
FIG. 3 is a cross-sectional view taken about line A-A of the exemplary embodiment of FIG. 1 with the acting forces.

A textile web 4, for example, is inserted in the lines of intersection of the two hollow bodies 1, in the sectional area 2, to which the linear stresses .σ. of the two hollow bodies 1 are transmitted in the line of intersection, as shown in FIG. 3. The tensile strength of the web 4 is essential. Taking into account this fact, other materials, preferably in the form of films, are naturally also according to the invention.

A similar configuration as in FIGS. 1 and 2 can naturally be considered as a single hollow body which is longitudinally constricted by the two interconnected tension/compression elements 3 or the web 4, so that the same linear stress relationships occur, as described for FIGS. 1 to 3. FIG. 4 informally allows these two modes of observation. However, the two end caps 5 then go over into a single end cap 5.

FIG. 3 shows the vectorial addition of the linear stresses .σ. to the linear force fin the web 4:

$$\vec{f}=\vec{\sigma}_1+\vec{\sigma}_2$$

where $\vec{f}$=linear force in the web 4

$\vec{\sigma}_1$=linear stress in the left hollow body $\vec{\sigma}_2$=linear stress in the right hollow body For the same pressure p and the same radius R, the absolute magnitude of $\vec{f}$ is dependent on the angle of intersection of the two circles of intersection of the two hollow bodies 1.

In order to absorb tensile and compressive forces of the pneumatic structural element thus constructed, the web 4 is clamped into a tension/compression element 3 having the form shown in FIGS. 2*a*-2*d*. The tension/compression element 3 absorbs the part of this linear force determined by the vector addition, as shown above, and is thereby pre-tensioned in the direction given by the vector representation. By filling the hollow body 1 with compressed air, a pre-tensioning of the web 4 by the linear force $\vec{f}$ is obtained as $f=2\sigma \sin \phi$. The linear force $\vec{f}$ thus describes the resultant of the forces exerted by the casing on the web, which is designated by .σ. in FIG. 3. Since the radius along the structural element is not generally constant, the pre-tensioning of the web along the structural element varies. By a suitable choice of the casing circumference and web height, the pre-tensioning of the web can be optimized according to the use of the pneumatic structural element or even made constant.

This pre-tensioning brings about a behavior of the tension/compression element 3 similar to a pre-tensioned string which only responds with a change in length when the pre-tensioning force is exceeded. Only when this pre-tensioning force is exceeded is there a risk of the tension/compression element 3 being bent. As a result of the indicated type of elastic bedding of the tension/compression element 3, in the pneumatic structural element according to the invention, the spring constant k, unlike that known from D2, is determined by the elasticity of the web $$k=E$$

where

E=modulus of elasticity of web [N/m$^2$].

The modulus of elasticity of the web is determined by the material. For textile webs the modulus of elasticity is in the range of $10^8$ N/m$^2$. A typical value for the internal pressure p is $10^4$ N/m$^2$ (100 mbar). By incorporating the web, the spring hardness has thus been increased by orders of magnitude and accordingly also the bending load.

In the pneumatic structural element according to the invention, therefore, the compressed air is used for pre-tensioning the flexible web so that this can transmit tensile and compressive forces and optimally stabilize the compression member against bending. The pneumatic structural element thus becomes more stable and light and is better able to bear local loads. Furthermore, complex three-dimensional pneumatic structural elements such as a wing, for example, can be implemented with the webs 4 and by combining with the tension/compression elements 3, these have a substantially greater load-bearing capacity than conventional pneumatic structures.

The tension/compression element 3 is laterally stabilized by the linear stresses .σ. in the casing 9.

The web 4 running through the structural element forms, together with the tension/compression elements 3, a braced support for a load acting on the support in each case, directed towards the bracing. The web 4 with the tension/compression elements 3 can also be interpreted as a truss as follows.

Figure 2B:
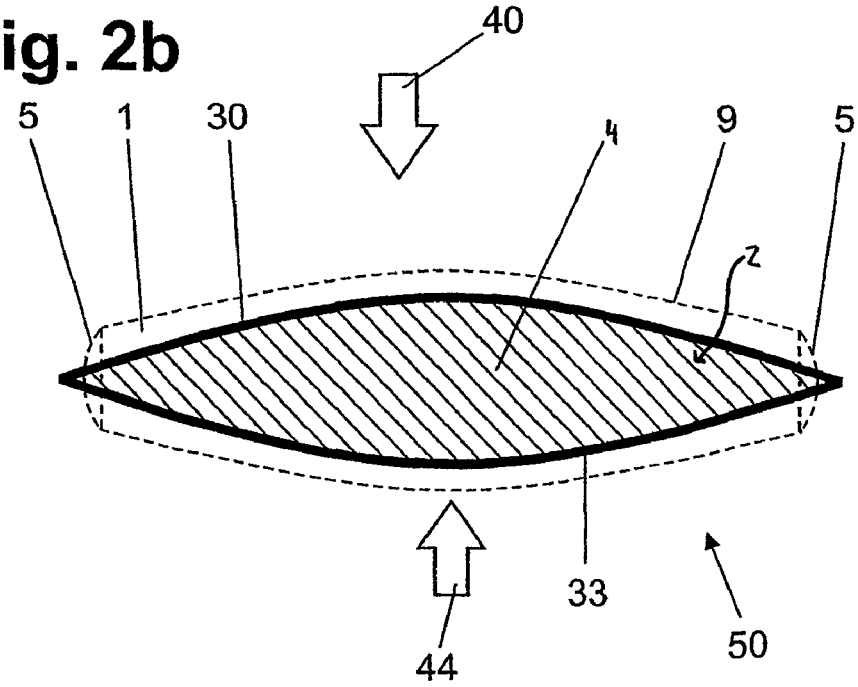
FIG. 2*b* is a cross-sectional view above line B-B of the exemplary embodiment of FIG. 1 with operational forces shown thereon.

If, during operation, a load is acting on one of the tension/compression elements 3, for example, on the tension/compression element configured as a compressively loadable stiffening element 30 as a result of the loading direction (arrow 40), see FIG. 2*b*, the element 30 fulfills the function of an upper chord of the truss 50 and the tension/compression element configured as a tensile-loadable element 33 fulfils the function of a lower chord. The truss 50 thus consists of web 4, compressively loadable stiffening element 30 and tensile-loadable stiffening element 33.

The load symbolized by the arrow 40 is usually a load distributed over the length of the element 30. In the case of a likewise possible local load, the element 30 must be correspondingly configured as rigid to prevent local bending.

As mentioned, the web 4 is pre-tensioned by the internal pressure prevailing in the structural element by a force corresponding to the linear force $\vec{f}$. Under load, the compressively loadable stiffening element 30 is displaced in the direction of action of the load 40. If in the case of a distributed load, the latter remains below the linear force $\vec{f}$, the displacement is small (and takes place in accordance with the modulus of elasticity of the still pre-tensioned web 4). However, if the linear force $\vec{f}$ exceeds this, the displacement is greater with the risk that the truss 50 will be overstressed.

The deformation under a load below the linear force $\vec{f}$ is thus smaller than is the case in the pneumatic elements of the prior art. If the operating load does not exceed the linear load $\vec{f}$, to a first approximation there is no deformation of the structural element according to the invention even when the load is non-constant.

If the compressively loadable stiffening element 30 and the tensile-loadable connecting element 33 are formed in the same manner, for example, as supports as shown in FIGS. 4 to 8, the truss 50 exhibits symmetry with the result that when a load 44 is acting, the same relationships prevail: the stiffening element 33 is compressively loadable and acts as an upper chord of the truss 50; the stiffening element 30 is tensile-loadable and acts as its lower chord. Loading capacity is therefore provided from both sides (load 40 and load 44).

In another embodiment according to the invention, the tensile-loadable stiffening element 33 is exclusively configured as tensile-loadable, for example, as a flexible tension member such as is represented by a cable. Then, the load-bearing capacity of the truss 50 is only unilateral, given here by the load 40. The pre-determined spacing of the stiffening elements 30, 33 (tension/compression members 3) is ensured by the internal pressure 9 which pre-tensions the flexible web 4 by means of the linear force $\vec{f}$ operationally, for example, in the manner shown in FIG. 4. This embodiment is characterized by low weight and, as mentioned, is suitable for unilateral load (load 40).

According to the invention, the web 4 and the elements arranged thereon (tension/compression members 3 or compressively loadable stiffening element 30 and tensile-loadable stiffening element 33 in the embodiment of FIG. 2*b*) are operatively connected to the casing 9, i.e. are connected in such a manner that forces can be transmitted and the compressively loadable stiffening element in the manner of an upper chord can absorb the corresponding (i.e., acting in the direction of the lower chord) load acting on the structural element. It is thus not important whether the load (40, 44) acting on the stiffening element 30, 33 acts directly on the element 30, 33 or is introduced via the casing 9 (FIG. 4) into the element 30, 33. The latter would be feasible if a roof according to FIG. 13 bears a snow load or in the case of an aerofoil according to FIGS. 10 and 11. It is also feasible that the load acts directly on the web 4 and is introduced via said web into the element 30, 33 which is likewise understood as a load acting directly on the element 30, 33 for the purpose of the description of the invention.

If the load 40 exceeds the linear load $\vec{f}$, the truss 50 becomes deformed accordingly but continues to bear the load 40, 44 until either the compressively loadable element 30 bends or is destroyed as result of the compressive stresses or the tensile-loadable element 33 tears. In this case, it is naturally required that the elements 30, 33 retain their relative position with respect to one another which is crucial for the bearing properties of the truss 50. This relative position is ensured by the pretension prevailing in the web 4 as a result of the linear force $\vec{f}$. Thus, in addition to the afore-mentioned mechanical load-bearing capacity of the elements 30, 33, the permissible deformation of the truss 50 is obtained as a second boundary condition for the maximum load 40, this being given as long as the pre-tensioning of the web 4 as such still exists. The latter is dependent on the internal pressure p.

According to the invention, exceptional loading properties of the pneumatic structural element are obtained together with the advantages of a pneumatic structural element whose elements 30, 33 are of comparatively low weight and the smallest possible mass. In addition, said element has the properties (load absorption, mass) of an optimized conventional truss without considerable expenditure (design, production and costs) needing to be incurred to optimize the conventional truss.

Figure 2C:
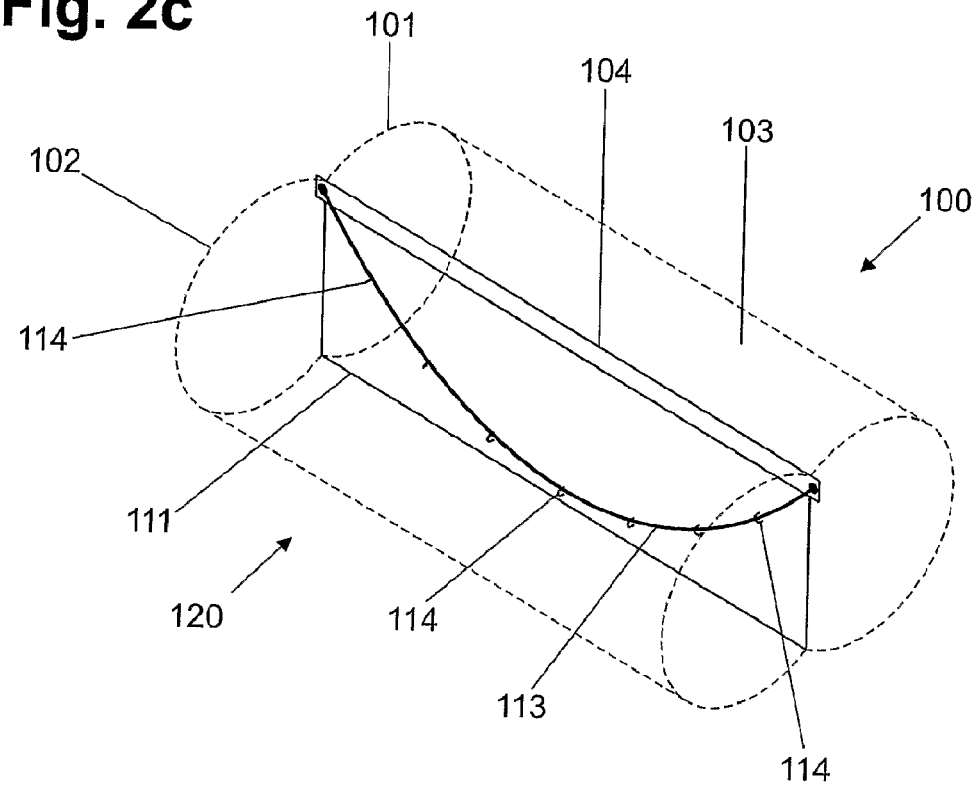
FIG. 2*c* is a perspective view of an exemplary embodiment of a pneumatic structural element.

Another preferred exemplary embodiment of the structural element according to the invention is shown in FIG. 2*c*.

The figure shows a pneumatic structural element 100 formed by a web 110 to give two cylindrical sections 101 and 102 in the manner of a double cylinder. The casing 103 (consisting of a flexible gas-tight material) is connected to a compressively loadable element configured as a straight, compressively loadable support 104 and is operationally connected via this to the web 110 in the manner shown in FIGS. 4 to 7. Along its other longitudinal side 111, the web 110 is connected to the casing 103, for example, by welding or by gastight sewing. The internal pressure p braces the web 110 made of flexible material to give the flat rectangular form shown.

A tensile-loadable flexible tension member runs in the web 110, for example, a wire cable 113 that is fixed by means of connections 114 in a fixed position on the web 110 in an operational position. A truss 120 is thus obtained, this being formed from the cable 113, the support 104 and the web 110 which ensures the operational position of the truss elements as a result of its pre-tension (linear force $\vec{f}$)

The connections 114 can also be formed as tabs guided through the web 110 or by any suitable technical method.

This arrangement makes it possible to configure the external form of the casing independently of the arrangement of the elements of the truss 120; there is no need for the spindle-like shape according to FIGS. 1 and 2.

It is within the scope of the present invention to configure both the web 110 and also the tensile-loadable stiffening elements 113 as partially fixed and partially flexible, which for example in the case of the tension element 113 can be used for better fixing on the web 110 or for other purposes.

Likewise, in addition to the form of a double cylinder, another arbitrary configuration of the casing 103 can also be provided within the scope of the design according to the invention.

Figure 2D:
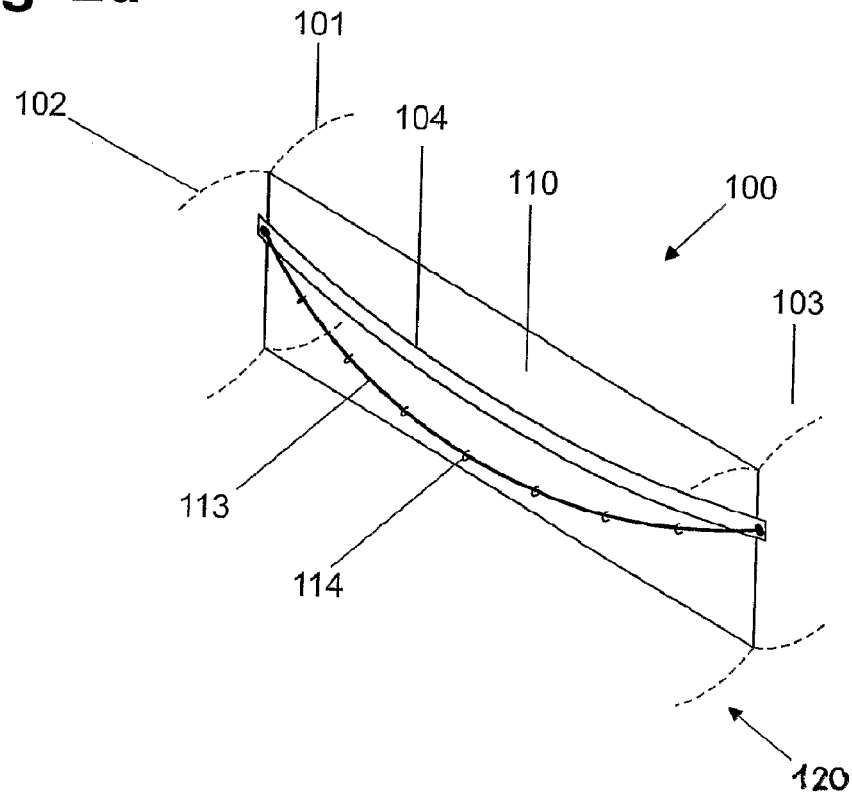
FIG. 2*d* is a perspective view of an exemplary embodiment of a pneumatic structural element.

FIG. 2*d* shows another embodiment of the structural element according to the invention, wherein the parts shown have the same reference numerals as in FIG. 2*c*. The support 104 is arranged downwardly offset in the web 110 and is no longer directly, but nevertheless operatively, connected to the casing 103. In addition, the support 104 is arranged in a curved manner. The person skilled in the art can freely determine the permissible curvature of the support 104 depending on the application; the boundary condition is that the support 104 remains in the compression zone of the truss (support 104, web 110 and tension element 113) over its entire length. The supporting properties of this embodiment are the same as those of the embodiment from FIG. 2*c*.

Figure 4:
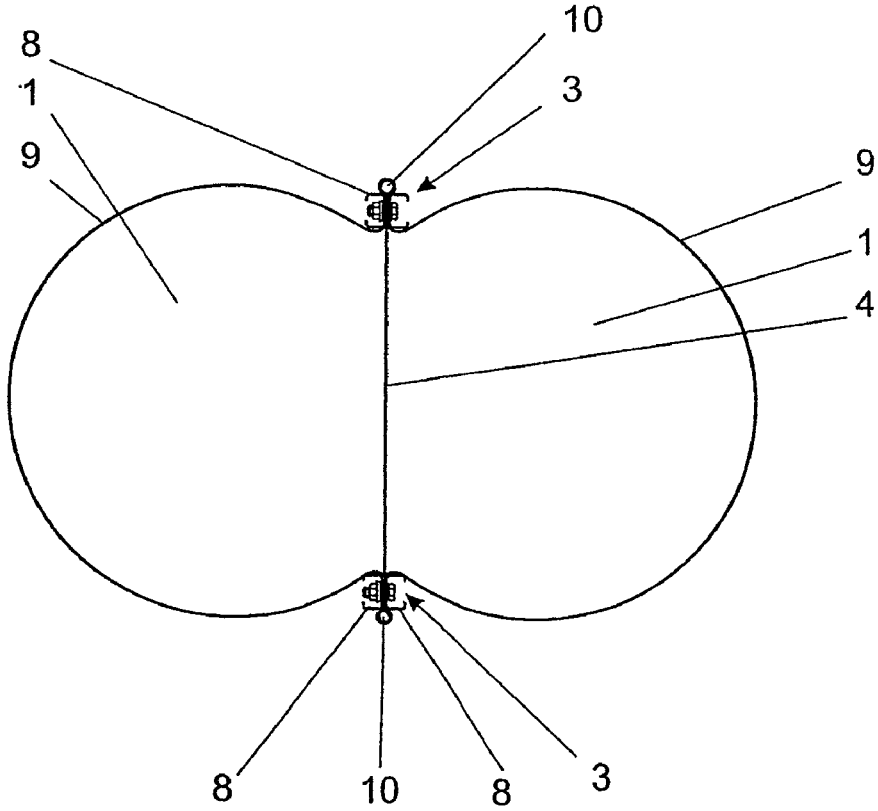
FIG. 4 is the cross-section AA of FIG. 3 with an exemplary embodiment of a tension/compression element.

FIG. 4 shows a technical embodiment of the diagram according to FIG. 3 in the section AA according to FIG. 1. The tension/compression element 3 in this case, for example, consists of two C profiles 8 which have been screwed together. The casing 9 of the hollow body 1 is, for example, pulled between the C profiles 8 without interruption and is secured externally on the tension/compression element 3 by means of a beading 10. The web 4 is inserted between the external layers of the casing 9 and is clamped securely by the screw connection of the C profiles 8.

Figure 5:
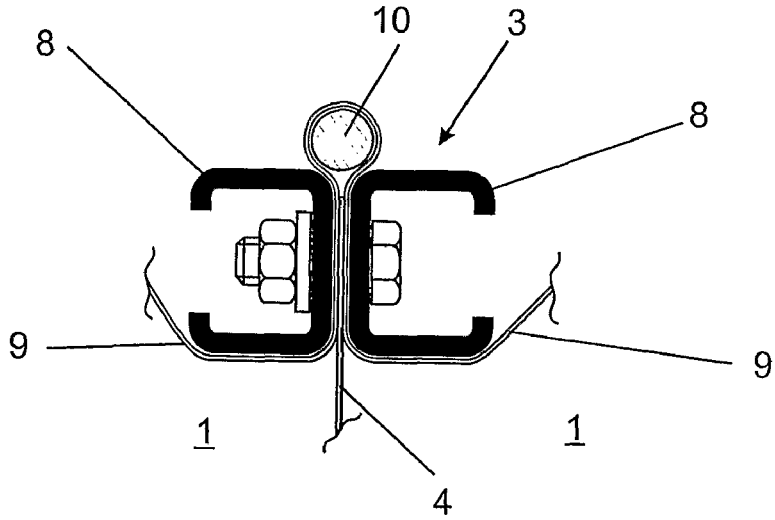
FIG. 5 is a cross-sectional view through a first exemplary embodiment of a tension/compression element in detail.

FIG. 5 shows a section through the tension/compression element 3 thus executed in detail.

Figure 6:
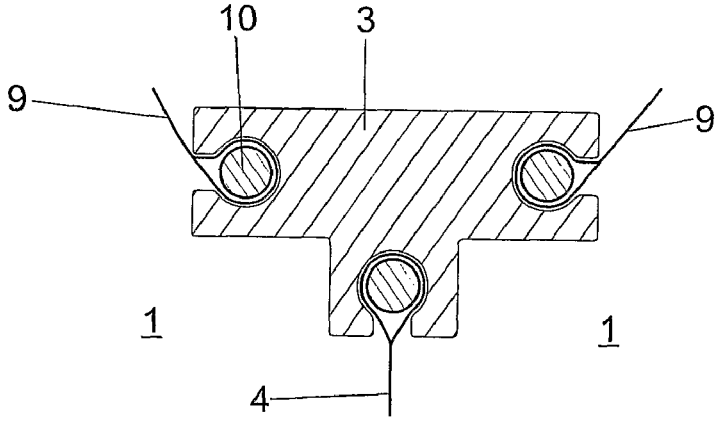
FIG. 6 a cross-section through a second exemplary embodiment of a tension/compression element.

FIG. 6 shows a variant for the design of the tension/compression element 3 in cross-section. The tension/compression element 3 here has three grooves for beadings 10. The casings 9 of the two hollow bodies 1 are inserted in the upper two grooves by means of beading 10 and the web 4 is inserted in the lower groove.

Figure 7:
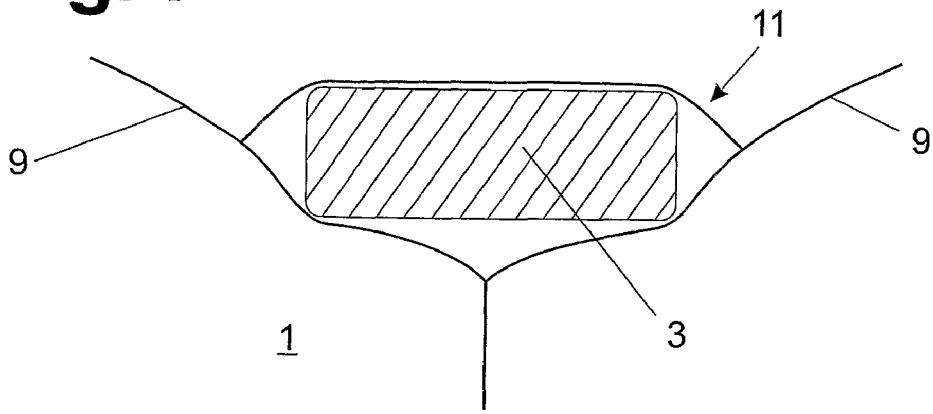
FIG. 7 is a cross-section through a third exemplary embodiment of a tension/compression element.

FIG. 7 shows a cross-sectional view of another variant of the tension/compression element with its fixing. Here, for example, the tension/compression element 3 has a rectangular cross-section but can also be differently designed to optimize the areal moment of inertia. Said element is inserted in a pocket 11 which is connected to the casing 9 by welding or sewing and then sealing.

Figure 8:
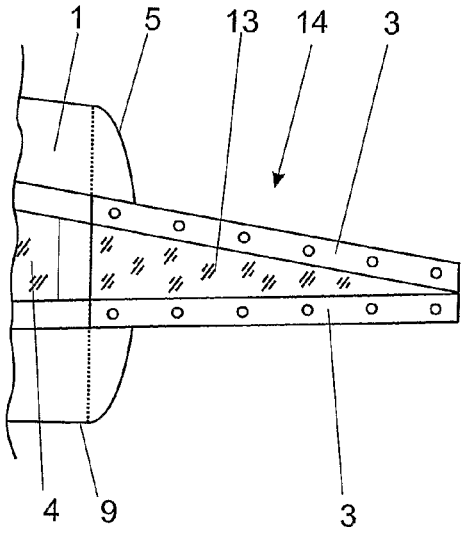
FIG. 8 is a side view of a node element.

At their ends, the tension/compression elements 3 are brought together in a node 14, as shown in FIG. 8. Such a node can be designed in manifold ways and is known per se in static calculations. Here this node consists of a plate 13 which is screwed, for example, to the tension/compression elements 3. The air-tight termination of the casing 9 can also be achieved in various ways. The important thing here is that the tension/compression elements 3 are guided out of the casing 9 and the node 14 lies freely for suitable fixing, for example, on a support.

Figure 9:
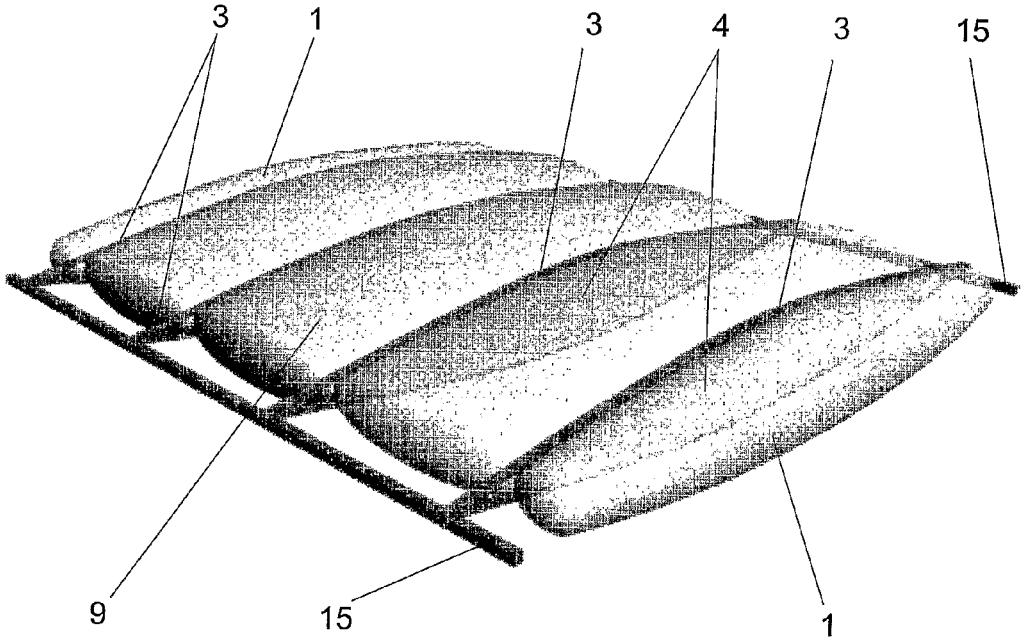
FIG. 9 is an isometric projection of a surface structure of pneumatic structural elements.

FIG. 9 shows the isometric projection of a pneumatic structural element according to this invention. A plurality of tension/compression elements 3 are provided here, one web 4 being inserted in each case according to FIGS. 2*a*-2*d*. Respectively one hollow body 1 is clamped between two neighboring tension/compression elements 3 and filled with compressed gas. The two outermost tension/compression elements 3 are each adjoined by an unpaired hollow body 1 to produce the pre-tensioning of the tension/compression element 3 and to laterally stabilize the tension/compression elements 3. Such a surface structural element can be constructed such that all the tension/compression elements 3 and the casings 9 of the hollow bodies 1 are already mounted and the entire arrangement described is placed on supports 5 and then filled with compressed gas. Alternatively assembly can take place on site by fixing the tension/compression elements 3 on the supports and then joining the casings 9 to the tension/compression elements 3.

Figure 10:
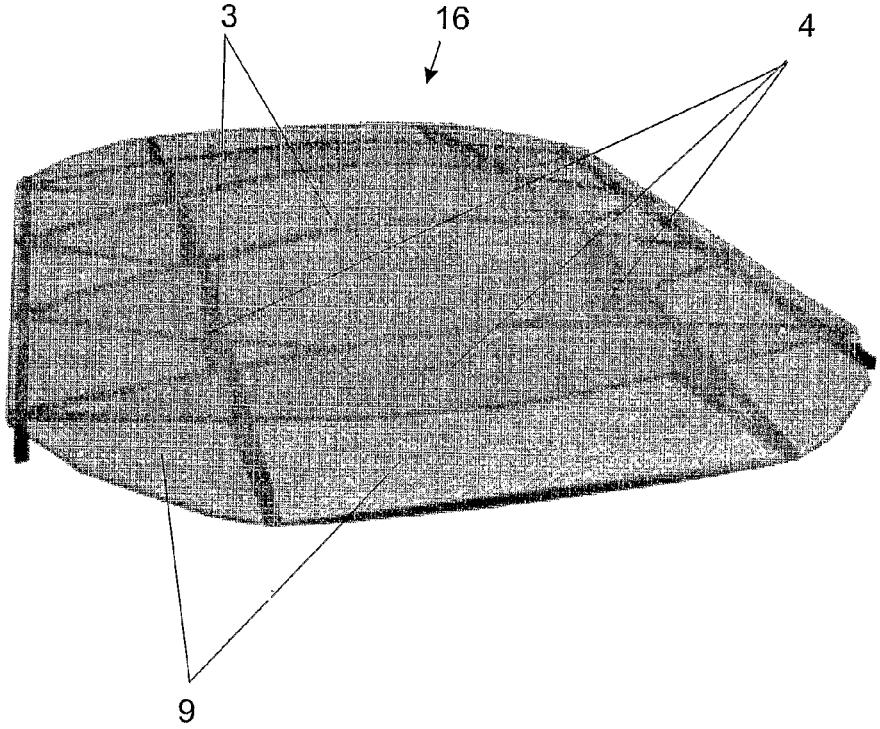
FIG. 10 is an isometric projection of a two-dimensional member of pneumatic structural elements.

In the diagram in FIG. 10 two groups of tension/compression elements 3 are arranged in a crossed manner and form a two-dimensional member 16 having a high bending strength in two, for example perpendicular, axial directions. The gastight terminations in the regions where the tension/compression elements 3 cross one another can, for example, be achieved by means of beadings; numerous other solutions are naturally also possible here.

The advantage of a configuration as an actual two-dimensional member 16 according to FIG. 10 is that the individual tension/compression elements 3 are preferably stabilized against tilting and no moments need to be applied by a suitable support.

Figure 11:
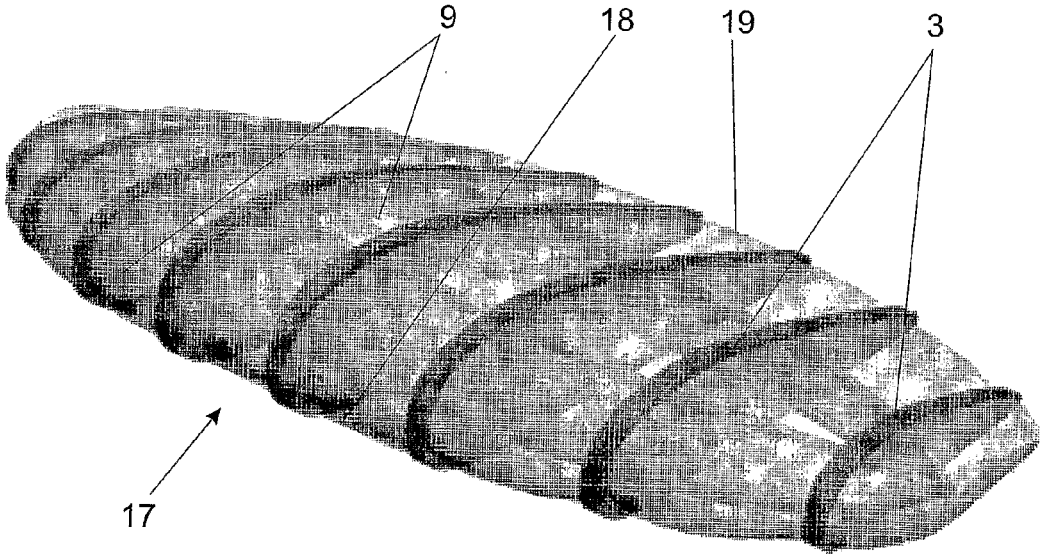
FIG. 11 is an isometric projection of an aerodynamic aerofoil profile.

FIG. 11, starting from FIG. 10, shows an aerofoil profile 17 according to the invention. As according to FIG. 10, two groups of tension/compression elements 3 are arranged in a crossed manner here. The numbers of tension/compression elements 3 in the two groups, here two in one direction and eight in the other direction, can be adapted to the requirements for the aerofoil profile 17. Likewise, the formation of the contours of the tension/compression elements 3 is variable in the sense that in addition to the static requirements on such a profile, the aerodynamic shapes of leading and trailing edges 18, 19 can be suitably configured, in any case using profile attachments which are aerodynamically effective but are not part of the statics of the aerofoil profile 17 with regard to its properties as a two-dimensional member.

Figure 12:
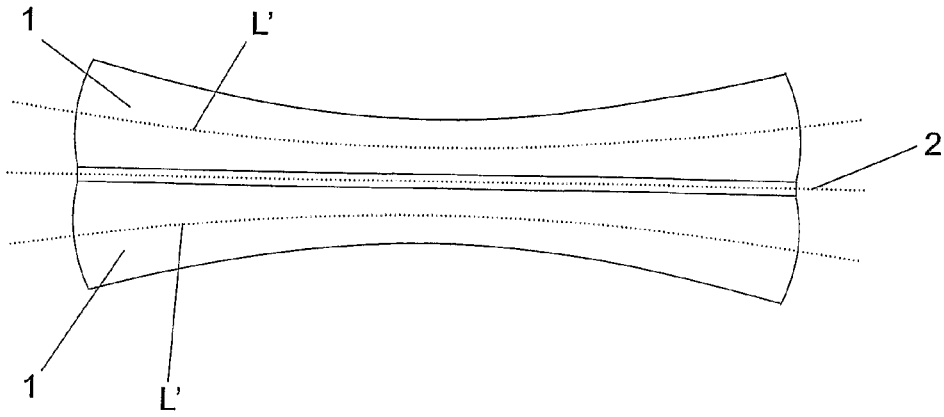
FIG. 12 is a plan view of an exemplary embodiment of a pneumatic structural element.

In the exemplary embodiment according to FIG. 12, the center lines L of the hollow body 1 are not straight as in the exemplary embodiments according to FIG. 1 but are outwardly curved from the interface 2 of the two hollow bodies 1. The two hollow bodies 1, which intersect one another in the sectional area 2 according to FIGS. 2*a*-2*d* and which remain unchanged in their shape, therefore have the smallest diameter in the cross-section AA according to FIG. 1. At the ends of the hollow body 1, this increases however. Thus, the linear stress a proportional to the local radius R also increases. Thus, the linear force transmitted to the web 4 can be increased or, generally speaking, optimized. Instead of a local radius increasing towards the ends of the hollow body 1, it is naturally also possible to select a constant or decreasing radius. In the latter case, the linear stress decreases towards the ends of the hollow body 1 and therefore of the web 4. This can be achieved by a center line L which is bent towards the ends of the hollow body 1 towards the interface 2. The same applies to hollow bodies 1 having approximately constant radius, i.e. of toroidal shape.

Figure 13:
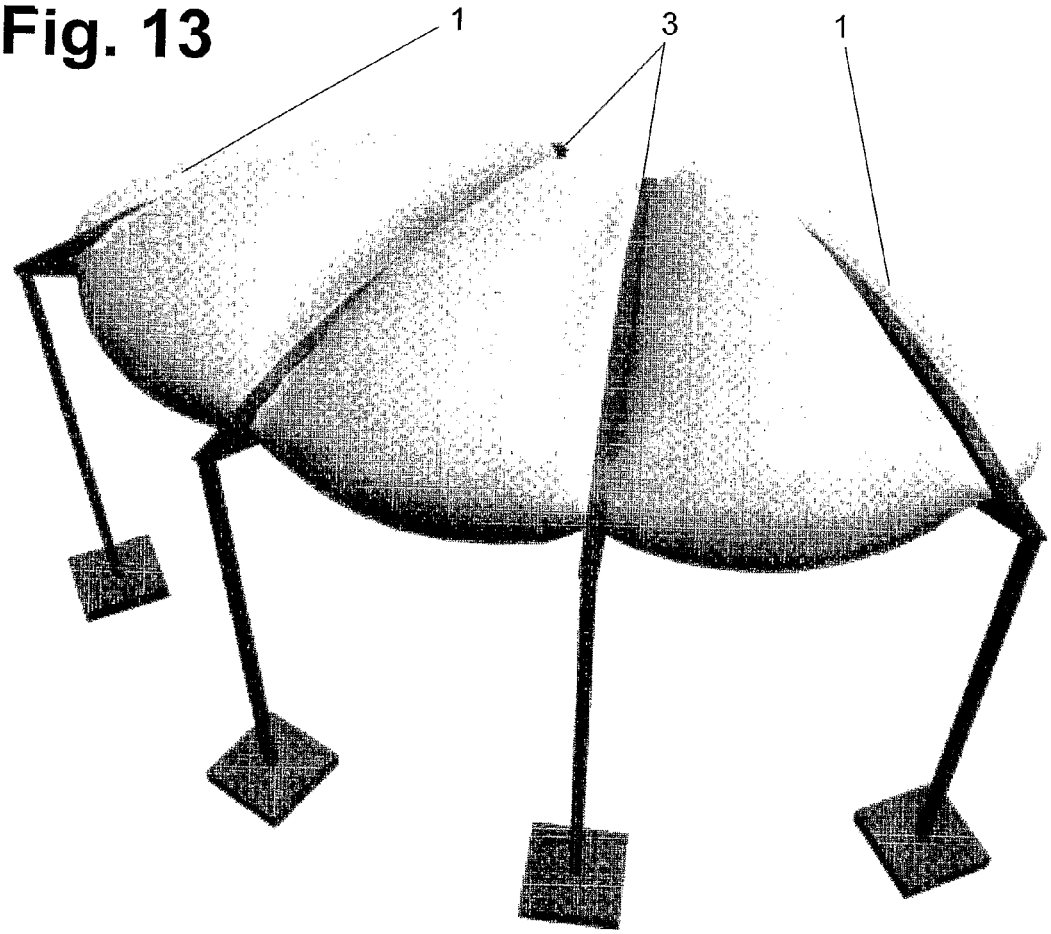
FIG. 13 is an isometric projection of a second exemplary embodiment of a surface structure of pneumatic structural elements.

FIG. 13 shows another exemplary embodiment of the inventive idea. Here a plurality, in FIG. 13 for example, five, of hollow bodies 1 are arranged on a further smaller plurality of tension/compression elements 3. These in turn bear webs 4 and are guided out from the hollow bodies 1 in a gas-tight manner. The tension/compression elements can be differently selected both according to their length, their height and also their direction. In each case as described for FIG. 9, respectively one hollow body 1 is then joined to the two outermost tension/compression elements 3 and fixed thereon in order to symmetrise the linear stresses in the said two outermost tension/compression elements 3 and their webs 4 and to laterally stabilize said elements.

Although various embodiments of the device of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

The invention claimed is:

1. A pneumatic structural element comprising:

a gas-tight casing;

a plurality of tension/compression elements extending from a first end of the pneumatic structural element to a second end of the pneumatic structural element, the plurality of tension/compression elements comprising:

at least one compressively loadable stiffening element;

at least one tensile-loadable stiffening element;

wherein the at least one compressively loadable stiffening element and the at least one tensile-loadable stiffening element are connected to one another at a common node on respective ends;

wherein, responsive to an application of an operational load, the at least one compressively loadable stiffening element is stressed by axial compression and the at least one tensile-loadable stiffening element is stressed by axial tension;

a flexible web is disposed within said pneumatic structural element between a first end region of the pneumatic structural element and a second end region of the pneumatic structural element, the flexible web operable to connect an upper portion of the gas-tight casing to a lower portion of the gas-tight casing, the flexible web comprising a tensile-loadable material;

wherein the flexible web is pre-tensioned by said pneumatic structural element under an operating pressure of said pneumatic structural element; and wherein the at least one compressively loadable stiffening element and the at least one tensile loadable stiffening element are connected to the flexible web along a length of the at least one compressively loadable stiffening element and the at least one tensile loadable stiffening element.

2. The pneumatic structural element according to claim 1, wherein the flexible web comprises:

a flexible gas-tight material;

wherein, each side of the flexible gas-tight material is connected to a respectively associated casing wall of the gas-tight casing over a length of the flexible gas-tight material; and wherein, the flexible gas-tight material is operationally pre-tensioned responsive to the application of an operating pressure.

3. The pneumatic structural element according to claim 1, wherein:

the at least one tensile-loadable stiffening element is at least partially flexible;

the at least one tensile-loadable stiffening element is fixed in a fixed position on the flexible web over a length of the at least one tensile-loadable stiffening element; and responsive to the application of an operating pressure, the at least one tensile-loadable stiffening element forms an upper chord of a truss.

4. The pneumatic structural element according to claim 1, wherein the tensile-loadable stiffening element is also compressively loadable and the compressively loadable stiffening element is also tensile-loadable.

5. The pneumatic structural element according to claim 1, wherein the compressively loadable stiffening element is a straight support.

6. The pneumatic structural element according to claim 1, wherein comprising:

at least two elongated hollow bodies the at least two elongated hollow bodies comprising:

a gas-tight casing of flexible material; and at least two tension/compression elements connected to one another at respective ends in the common node the at least two tension/compression elements are connected to the casing substantially over an entire length of the at least two tension/compression elements; and wherein a flexible web comprising a high-tensile-strength material is disposed between the at least two tension/compression elements and is connected to the two tension/compression elements in a tensile manner over substantially the entire length of the at least two tension/compression elements, in such a manner that when the at least two hollow bodies are filled with a compressed gas, a stress of the gas-tight casings is transmitted to the at least two tension/compression elements and to the flexible web pre-tensioning said flexible web.

7. The pneumatic structural element according to claim 1, wherein:

at least one of the plurality of tension/compression elements comprises two C profiles secured to one another by a screw connection;

at least one of the plurality of tension/compression element comprises a bead, the bead comprising the flexible material;

the bead is disposed on an outside of the at least one of the plurality of tension/compression element; and the flexible web is firmly clamped between the two C profiles of the at least one of the plurality of tension/compression element by the screw connection.

8. The pneumatic structural element according to claim 1, wherein:

at least one of the plurality of tension/compression elements comprises a profile rod having grooves;

two grooves are disposed laterally and a third groove is disposed centrally; and the gas-tight casing is firmly clamped by a lateral beading and the flexible web is firmly clamped by a centrally disposed beading.

9. The pneumatic structural element according to claim 1, wherein:

at least one of the plurality of tension/compression elements comprises a profile rod;

each profile rod is inserted in a pocket running longitudinally to the at least one of the plurality of tension/compression element;

the gas-tight casing of a hollow body is connected to the pocket in a gas-tight manner;

the flexible web is connected to the pocket; and the connections of the casings and the flexible web to the pocket are produced by welding or adhesive bonding or sewing with subsequent sealing.

10. The pneumatic structural element according to claim 1, wherein means are provided for guiding at least one pair of the plurality of associated tension/compression elements in a gas-tight manner out from a hollow body or bodies, and wherein the common nodes of the at least one pair of the plurality of tension/compression elements are disposed outside the hollow body.

11. The pneumatic structural element according to claim 1, wherein:

a gas-tight hollow body is inserted between two neighboring pairs of tension/compression elements and is connected to said plurality of tension/compression elements (3); and two outermost tension/compression elements comprise an unpaired hollow body operable to make pre-tensioning of the flexible web symmetrical and to laterally stabilize said flexible web.

12. The pneumatic structural element according to claim 1, wherein the common nodes are placed on a support and fixed thereon.

13. The pneumatic structural element according to claim 1, wherein:

the plurality of tension/compression elements are arranged in two groups, which cross one another, thereby forming a two-dimensional member;

a plurality of gas-tight hollow bodies are arranged in two intersecting groups;

the hollow bodies are connected to one another and to the tension/compression elements in a gas-tight manner; and the flexible webs run between the two tension/compression elements.

14. The pneumatic structural element according to claim 13, wherein the two-dimensional member has an aerodynamic form.

15. The pneumatic structural element according to claim 14, comprising attachments disposed on the plurality of tension/compression elements.

16. The pneumatic structural element according to claim 1, wherein the pneumatic structural elements are arranged adjacent to one another to form a roof or a base for a building.

* * * * *

UNITED STATES PATENT AND TRADEMARK OFFICE

CERTIFICATE OF CORRECTION

PATENT NO. : 7,836,636 B2
APPLICATION NO. : 12/086907
DATED : November 23, 2010
INVENTOR(S) : Luchsinger It is certified that error appears in the above-identified patent and that said Letters Patent is hereby corrected as shown below:

In the Specification
Column 3, Line 14: Replace “fin” with --f--

In the Claims
Column 10, Claim 10, Line 16: Delete “associated”

Signed and Sealed this
Twelfth Day of July, 2011

David J. Kappos

David J. Kappos
*Director of the United States Patent and Trademark Office*